US009701426B2

(12) United States Patent
Kim

(10) Patent No.: US 9,701,426 B2
(45) Date of Patent: Jul. 11, 2017

(54) DEVICE FOR DISTINGUISHING ERROR IN MEDICINE PACKING APPARATUS

(75) Inventor: Ho Yeon Kim, Anyang-si (KR)

(73) Assignees: CRETEM CO., LTD., Anyang-si (KR); ALIXA RX, LLC, Plano, TX (US)

( * ) Notice: Subject to any disclaimer, the term of this patent is extended or adjusted under 35 U.S.C. 154(b) by 718 days.

(21) Appl. No.: 13/989,568

(22) PCT Filed: Nov. 25, 2011

(86) PCT No.: PCT/KR2011/009059

§ 371 (c)(1),
(2), (4) Date: May 24, 2013

(87) PCT Pub. No.: WO2012/070906

PCT Pub. Date: May 31, 2012

(65) Prior Publication Data

US 2013/0232912 A1 Sep. 12, 2013

(30) Foreign Application Priority Data

Nov. 26, 2010 (KR) ..... 20-2010-0012245 U

(51) Int. Cl.
*B65B 5/10* (2006.01)
*B65B 57/14* (2006.01)
(Continued)

(52) U.S. Cl.
CPC ..... *B65B 1/04* (2013.01); *B65B 5/10* (2013.01); *B65B 35/56* (2013.01); *B65B 57/14* (2013.01); *B65B 5/103* (2013.01)

(58) Field of Classification Search
CPC ..... B65B 39/002; B65B 39/003; B65B 57/06; B65B 57/10; B65B 57/14; G07F 17/0092
(Continued)

(56) References Cited

U.S. PATENT DOCUMENTS 5,010,929 A * 4/1991 Tisma ..... B65B 57/06 141/1
5,522,512 A * 6/1996 Archer et al. ..... B65B 57/14 209/580
(Continued)

FOREIGN PATENT DOCUMENTS

EP 0412806 A1 * 2/1991 ..... B65B 35/02
KR 10-2005-0117426 12/2005
(Continued)

OTHER PUBLICATIONS

International Search Report issued in PCT Application No. PCT/KR2011/009059 dated Jul. 18, 2012.

*Primary Examiner* — Stephen F Gerrity
(74) *Attorney, Agent, or Firm* — Ked & Associates LLP

(57) ABSTRACT

An error identifying device of a tablet medicine packing apparatus is disclosed. The error identifying device according to an exemplary embodiment of the inventive concept, which is prepared below a plurality of tablet cassettes containing each different kind of tablet, includes a tablet assembly space where tablets discharged from at least a part of the plurality of the tablet cassettes assembles, an error detecting unit detecting whether the kind and the number of the tablets assembled in the tablet assembly space are in accordance with a prescription or not, a first path and a second path guiding the tablets assembled in the tablet assembly space into each different direction, and a path selecting unit guiding the tablets assembled in the tablet assembly space into the first path if the kind and the number of the tablets are in accordance with the prescription, if not, guiding the tablets assembled in the tablet assembly space into the second path.

2 Claims, 5 Drawing Sheets

(51) Int. Cl.
*B65B 35/56* (2006.01)
*B65B 1/04* (2006.01)

(58) Field of Classification Search
USPC ..... 53/54
See application file for complete search history.

(56) References Cited

U.S. PATENT DOCUMENTS

| | | | | |
|---|---|---|---|---|
| 2004/0007442 | A1* | 1/2004 | Monti | B65B 57/14 198/538 |
| 2005/0217208 | A1* | 10/2005 | Cicognani | B65B 57/14 53/54 |
| 2005/0274728 | A1* | 12/2005 | Kim | B65B 5/103 221/7 |
| 2006/0124656 | A1* | 6/2006 | Popovich, Jr. | G07F 17/0092 221/9 |
| 2010/0043349 | A1* | 2/2010 | Yuyama et al. | B65B 57/14 53/52 |
| 2010/0077708 | A1* | 4/2010 | Kobayashi et al. | B65B 5/103 53/501 |
| 2010/0287880 | A1* | 11/2010 | Yasunaga et al. | G07F 17/0092 53/64 |
| 2012/0330684 | A1* | 12/2012 | Jacobs et al. | G07F 17/0092 705/3 |

FOREIGN PATENT DOCUMENTS

| | | | |
|---|---|---|---|
| KR | 10-2009-0031169 | 3/2009 | |
| KR | 10-0927487 | 11/2009 | |
| KR | 10-2010-0036947 | 4/2010 | |
| WO | WO 2009038380 A2 * | 3/2009 | B65B 57/14 |

* cited by examiner

DEVICE FOR DISTINGUISHING ERROR IN MEDICINE PACKING APPARATUS

CROSS-REFERENCE TO RELATED PATENT APPLICATIONS

This application is a U.S. National Stage Application under 35 U.S.C. §371 of PCT Application No. PCT/KR2011/009059, filed Nov. 25, 2011, which claims priority to Korean Patent Application No. KR 20-2010-0012245, filed Nov. 26, 2010.

TECHNICAL FIELD

Embodiments relates to a tablet medicine packing apparatus, and more particularly, to an error identifying device of a tablet medicine packing apparatus identifying tablet distributing errors and withdrawing tablets having the distributing errors seperately.

BACKGROUND ART

A medicine packing apparatus is an apparatus for discharging tablet medicines prescribed according to the illness of a patient and packing the tablet medicines in each dose automatically. The medicine packing apparatus includes an installation unit on which a plurality of tablet cassettes containing each different kind of tablet are mounted and a hopper disposed below the installation unit. The tablet medicines are discharged from each of the tablet cassettes that are controllable by a dose and then assembled in the hopper, and the tablets assembled in the hopper are discharged down the hopper and packed with sealed in a packing paper.

By the way, there is possibility of tablets being packed in a different assembly from a prescription due to blockage and congestion while tablets transfer from the tablet cassette to the hopper, thereby reliability of the automatic tablet medicine packing operation being damaged and wasting tablets and packing paper.

DETAILED DESCRIPTION OF THE INVENTION

Technical Goal of the Invention

The inventive concept provides an error identifying device of a tablet medicine packing apparatus withdrawing tablets assembled with unconformable combination to a prescription separately to increase reliability of automatic packing and to restrain waste of tablets and packing paper.

Technical Solution of the Invention

According to an exemplary embodiment of the inventive concept, an error identifying device of a tablet medicine packing apparatus, which is prepared below the plurality of tablet cassettes containing each different kind of tablet, may include a tablet assembly space, an error detecting unit, a first path, a second path, and a path selecting unit. Tablets discharged from at least a part of the tablet cassettes among the plurality of tablet cassettes are assembled in the tablet assembly space. The error detecting unit detects whether the kind and the number of the tablets assembled in the tablet assembly space are in accordance with a prescription or not. The first path and the second path guide the tablets assembled in the tablet assembly space to each different direction. The path selecting unit guides the tablets to the first path, if the kind and the number of the tablets assembled in the tablet assembly space are in accordance with the prescription, and guides the tablets to the second path, if the kind and the number of the tablets assembled in the tablet assembly space are not in accordance with the prescription.

The path selecting unit may include a rotary plate and a driving motor. The rotary plate may rotate to a default position holding up tablets in the tablet assembly space by blocking the first path and the second path, a first position guiding the tablets assembled in the tablet assembly space into the first path, and a second position guiding the tablets assembled in the tablet assembly space into the second path. The driving motor provides rotation power to rotate the rotary plate according to the result of detecting by the error detecting unit.

The error identifying device may further include a tablet container receiving tablets discharged through the second path.

The error identifying device may further include a locking mean for locking the tablet container such that tablets gathered in the tablet container may not be discharged randomly. At this time, the tablet container may be the form of a cup to be easily separated and includes a projection accepting groove at one end, and the locking mean may include a locking projection and a solenoid driver operating such that the projection may protrude or retreat from the projection accepting groove. Also, the solenoid drive may be driven affiliated with a button input device or a key.

Effect of the Invention

An error identifying device of a tablet medicine packing apparatus according to an exemplary embodiment of the inventive concept may withdraw tablets assembled with different combination from a description instead of discharging the tablets to a packing unit, accordingly, reliability of automatic packing may be increased and waste of tablets and packing paper may be reduced.

BRIEF DESCRIPTION OF THE DRAWINGS

Exemplary embodiments of the inventive concept will be more clearly understood from the following detailed description taken in conjunction with the accompanying drawings in which.

BEST MODE FOR CARRYING OUT THE INVENTION

Figure 1:
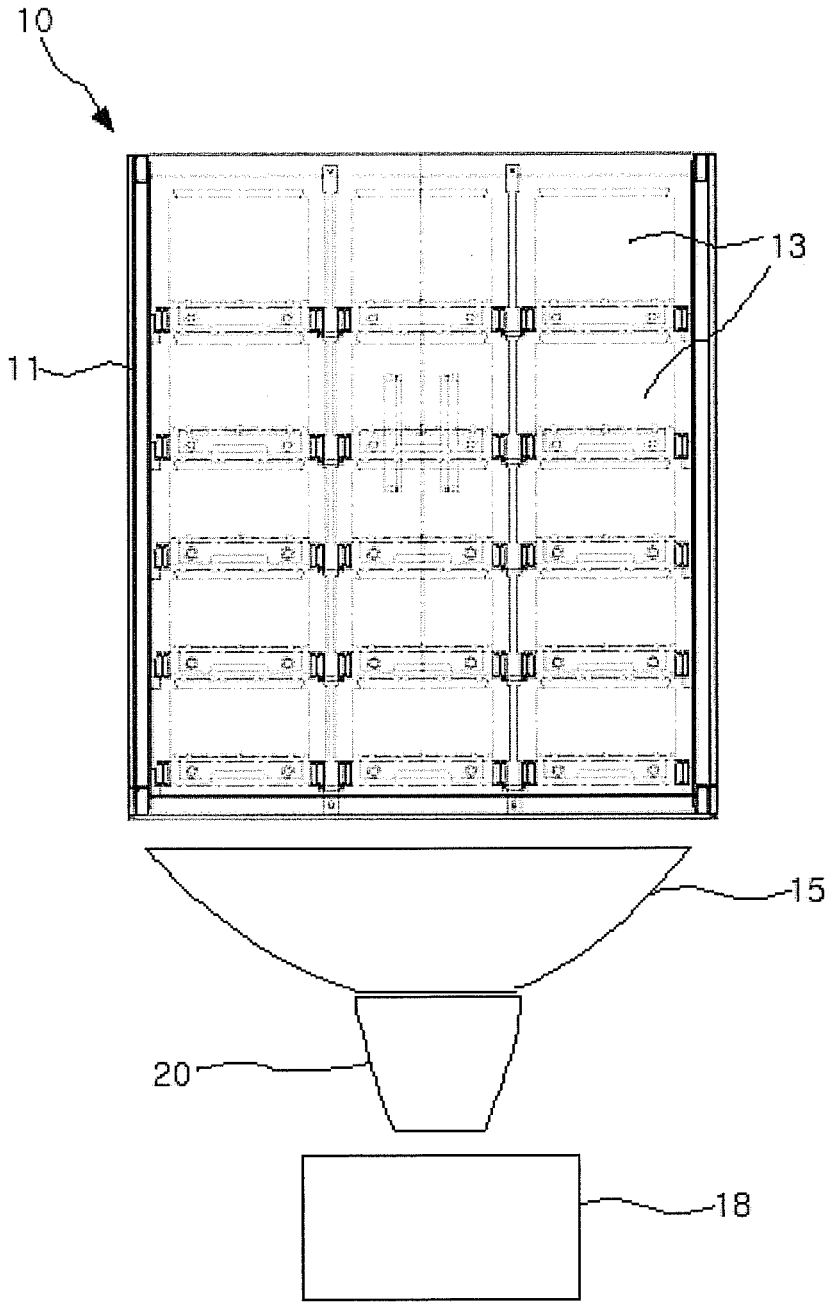
FIG. 1 is a structural diagram of a tablet medicine packing apparatus.

Various example embodiments will be described more fully hereinafter with reference to the accompanying drawings, in which some example embodiments are shown. Inventive concepts may, however, be embodied in many different forms and should not be construed as limited to the example embodiments set forth herein. Rather, example embodiments are provided so that this disclosure will be thorough and complete, and will fully convey the scope of inventive concepts to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the inventive concepts. As used herein, the term "and/or" includes any and all combinations of one or more of the associated listed items.

It will be understood that when an element is referred to as being "connected" or "paired" to another element, it can be directly connected or paired to the other element or intervening elements may be present. In contrast, when an element is referred to as being "directly connected" or "directly paired" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the inventive concepts. As used herein, the singular forms "a," "an" and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which inventive concepts belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a structural diagram illustrating an example of a tablet medicine packing apparatus. As shown in FIG. 1, the tablet medicine packing apparatus 10 includes an installation unit 11 and a hopper 15 beneath the installation unit 11. The installation unit 11 includes a plurality of tablet cassettes 13 containing each different kind of tablet medicine.

Tablets discharged from the tablet cassettes 13 selected according to a prescription fall down, are accepted by the hopper 15, and flows into an error identifying device 20 located beneath the hopper 15. Once the error identifying device 20 recognizes that the tablets are discharged in accordance with the prescription, the tablets flow into a packing unit 18 and are packed sealed with packing paper (not shown).

Figure 2:
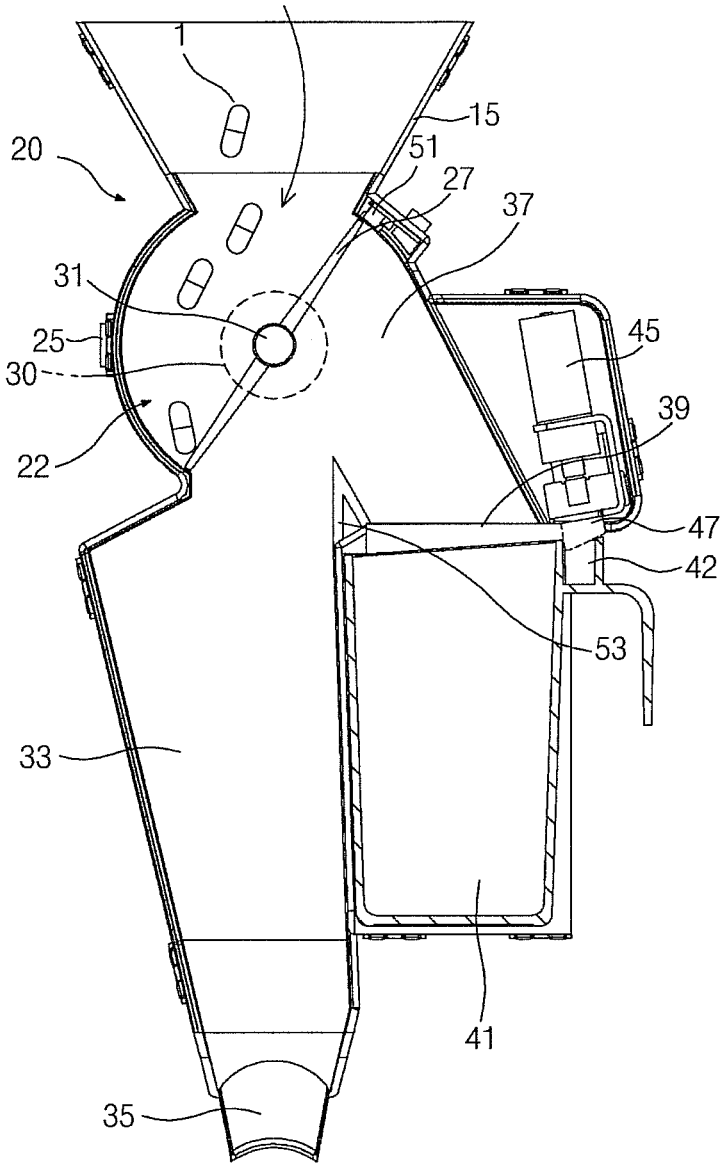
FIG. 2 is a cross-sectional view of an error identifying device according to an exemplary embodiment of the inventive concept, which shows an operating example in case of tablets being assembled in a tablet assembly space.
Figure 3:
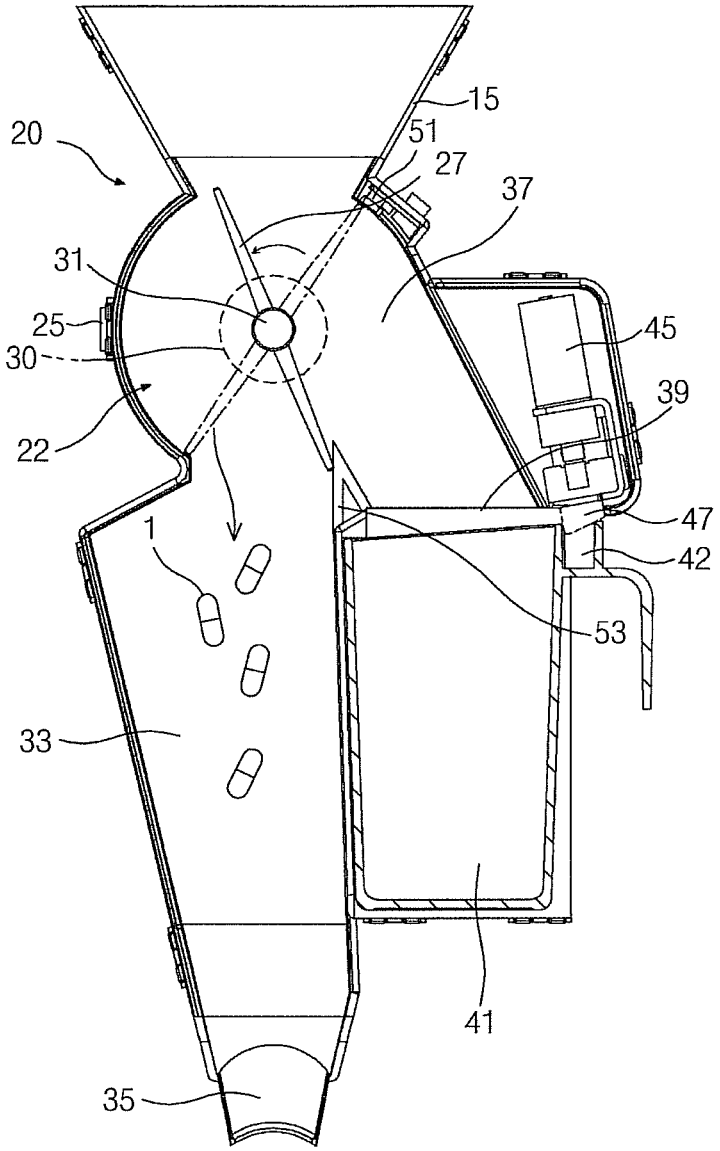
FIG. 3 is a cross-sectional view of an error identifying device according to an exemplary embodiment of the inventive concept, which shows an operating example in case of tablets being assembled in accordance with a prescription.
Figure 4:
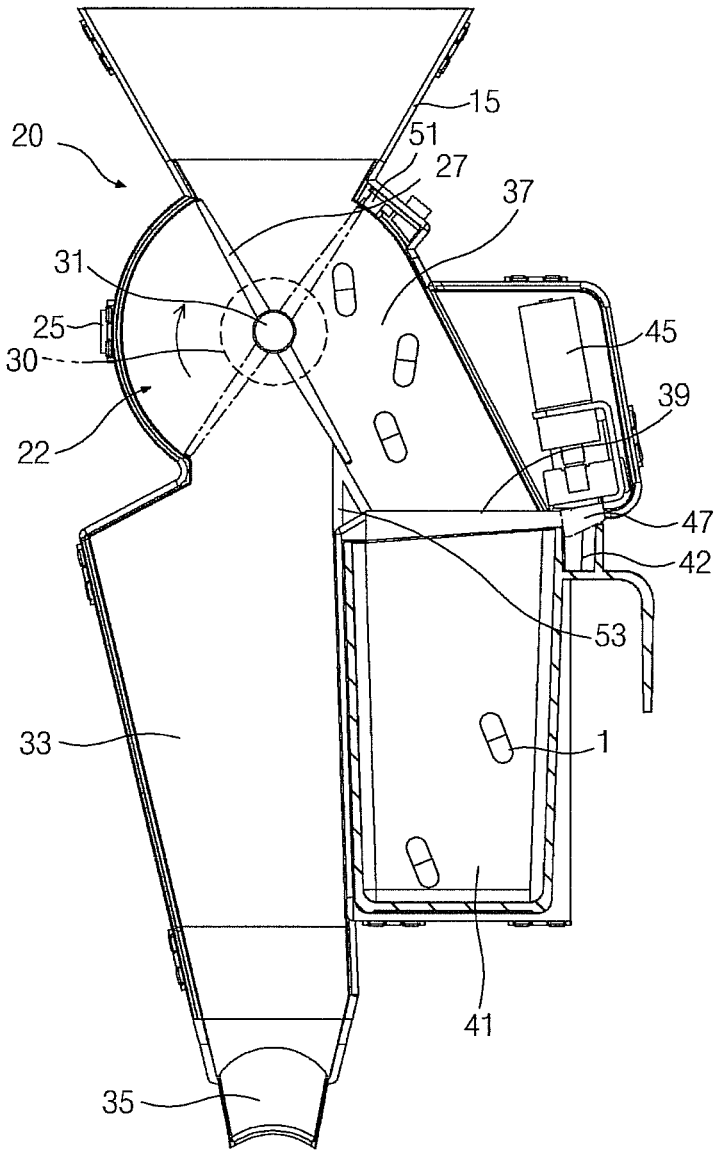
FIG. 4 is a cross-sectional view of an error identifying device according to an exemplary embodiment of the inventive concept, which shows an operating example in case of tablets being assembled differently from a prescription.

FIGS. 2 through 5 are cross-sectional diagrams illustrating an error identifying device according to an exemplary embodiment of the inventive concept. Referring to FIGS. 2 through 4, the error identifying device 20 includes a tablet assembly space 22, a first path 33, a second path 37, an error detecting unit, and a path selecting unit. Tablets 1 discharged from the tablet cassettes 13 and accepted by the hopper 15 flow to the tablet assembly space 22 and are assembled therein. The first path 33 and the second path 37 guide the tablets 1 assembled in the tablet assembly space to each different direction. The error detecting unit detects whether the kind and the number of the tablets assembled in the tablet assembly space 22 are in accordance with the prescription or not. The path selecting unit guides the tablets 1 to the first path 33 or the second path 37.

The error detecting unit includes an error detecting sensor 25. The error detecting sensor 25 is prepared in the tablet assembly space 22.

The path selecting unit includes a rotary plate 27 and a driving motor. The rotary plate 27 divides the tablet assembly space 22 and is installed so as to rotate inside the space 22. The driving motor 30 provides rotating power for rotating the rotary plate 27. A pivot 31 of the driving motor 30 is combined with the rotary plate 27.

The rotary plate 27 rotates to a default position stopped at the slope shown in FIG. 2, a first position stopped at the slope shown in FIG. 3, and a second position stopped at the slope shown in FIG. 4.

The default position is the position holding up the tablets 1 discharged from the hopper 15 in the tablet assembly space 22 by blocking the first path 33 and the second path 37. The default position is already set before the tablets 1 flow into the error identifying device 20 from the hopper 15.

The first position is the position for guiding the tablets 1 held up in the tablet assembly space 22 to the first path 33. The rotary plate 27 rotates counterclockwise from the default position (referring to FIG. 2) to connect the first path 33 with the tablet assembly space 22, which is at the first position (referring to FIG. 3). The second position is the position for guiding the tablets 1 held up in the tablet assembly space 22 to the second path 37. The rotary plate rotates clockwise from the default position (referring to FIG. 2) to connect the second path 37 with the tablet assembly space 22, which is at the second position (referring to FIG. 4).

The path selecting unit includes a first stopper 51 and a second stopper 53. The first stopper 51 helps the rotary plate 27 stop at the default position without a hitch. The first stopper 51 is installed fixed.

The second stopper 53 helps the rotary plate 27 stop at the default position without a hitch. The second stopper 53 is a variable stopper retreating such that the rotation of the rotary plate 27 may not be disturbed when the rotary plate 27 rotates from the default position to the second position.

Hereinafter, a method for operating the error identifying device of a tablet medicine packing apparatus according to an exemplary embodiment of the inventive concept will be described.

Referring to FIG. 2 again, the rotary plate 27 is stopped at the default position when the tablets 1 flow into the tablet assembly space 22 from the hopper 15, thus, the tablets 1 are held up at the tablet assembly space 22. At this time, the error detecting sensor 25 senses the kind and the number of the held up tablets 1.

Referring to FIG. 3, the pivot 31 of the driving motor 30 and the rotary plate 27 combined thereto rotates counterclockwise to change into the first position, when the kind and the number of the tablets 1 detected by the error detecting sensor 25 are in accordance with the kind and the number of tablets of the prescription. Accordingly, the tablets 1 fall down to the first path 33. The tablets 1 discharged to an outlet 35 of the first path 33 flow into the packing unit 18.

Referring to FIG. 4, the first stopper 51 retreats so as not to disturb the rotating path of the rotary plate 27, when the kind and the number of the tablets 1 detected by the error detecting sensor 25 are not in accordance with the kind and the number of the prescription. At the same time, the pivot 31 of the driving motor 30 and the rotary plate 27 combined thereto rotate clockwise to change into the second position. Accordingly, the tablets 1 flow into the second path 37.

Meanwhile, the error identifying device 20 further includes a tablet container 41 and a locking mean. The tablet container 41 contains tablets passed through the second path 37 and discharged to the outlet 39.

The locking mean is for locking the tablet container 41 such that tablets assembled in the tablet container 41 may not be discharged randomly and includes a locking projection and a solenoid driver 45.

The tablet container 41 is the form of a cup which is easy to be separated, and the container 41 includes a projection accepting groove 42 accepting the locking projection 47 at one end of the container 41.

The solenoid driver 45 drives the locking projection 47 to protrude or retreat from the projection accepting groove 42. Although it is not shown in detail, the solenoid driver 45 may be driven affiliated with a button input device or a key. At this time, the solenoid driver 45 may be installed fixed on the second path or adjacent to the second path.

Figure 5:
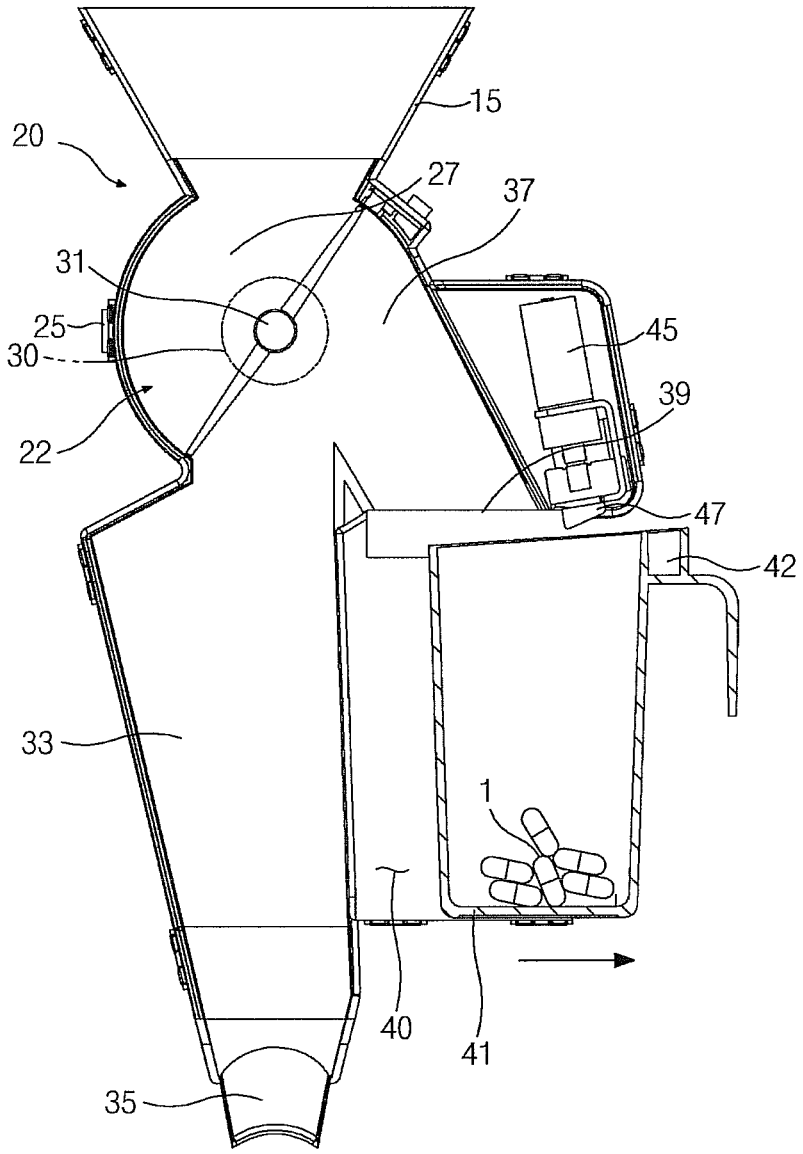
FIG. 5 is a cross-sectional view of an error identifying device according to an exemplary embodiment of the inventive concept, which shows an operating example of separating a tablet container where tablets are assembled.

The tablet container 41 is fixed to the error identifying device 20 while the solenoid driver 45 driving for the locking projection 47 to protrude so as to be inserted to the projection accepting groove 42 in the state of the tablet container 41 being loaded on the container installation unit 40 (referring to FIG. 5). Accordingly, tablets withdrawn and assembled in the tablet container 41 may not be discharged randomly.

Referring to FIG. 5, the solenoid driver 45 is driven to pull back the locking projection 47 by using a button input device or a key when the tablets 1 are accumulated in the tablet container 41.

Then, the tablet container 41 may be separated from the container installation unit 40 when the locking projection 47 gets out of the projection accepting groove 42. The tablets 1 accumulated in the tablet container 41 may be input again to the tablet cassette 13 (referring to FIG. 1) containing the same kind of tablets, when they are determined to be normal tablets through inspection. Meanwhile, the tablet container and the locking mean may be transformed, not restricted to the embodiment.

While the present invention has been particularly shown and described with reference to exemplary embodiments thereof, it will be understood that various changes in form and details may be made therein without departing from the spirit and scope of the following claims.

INDUSTRIAL USABILITY

The present invention is applicable to a tablet medicine packing apparatus packing tablet medicines by a dose automatically at hospitals, pharmacies, home, or the like.

What is claimed is:

1. An error identifying device of a tablet medicine packing apparatus, which is provided below a plurality of tablet cassettes containing each a different kind of tablet, the error identifying device comprising:

a tablet assembly space where tablets discharged from at least a part of the tablet cassettes among the plurality of tablet cassette assemble;

an error detecting unit that detects whether a kind and a number of the tablets assembled in the tablet assembly space are in accordance with a prescription;

a first path and a second path that guide the tablets assembled in the tablet assembly space each in a different direction; and a path selecting unit that guides the tablets assembled in the tablet assembly space into the first path if the kind and the number of the tablets assembled in the tablet assembly space are in accordance with the prescription, and if not, guides the tablets into the second path;

a tablet container that receives tablets discharged along the second path; and a locking means for locking the tablet container such that the tablets received by the container may not be discharged randomly, wherein the container is in the form of a cup so as to be separated easily and includes a projection accepting groove at one end, and wherein the locking means comprises:

a locking projection to be inserted to the projection accepting groove; and a solenoid driver that operates such that the locking projection may protrude into or retreat from the projection accepting groove, which is fixed on the second path or at a location adjacent to the first path.

2. The error identifying device of claim 1, wherein the path selecting unit comprises:

a rotary plate rotatable to a default position holding up the tablets in the tablet assembly space by blocking the first path and the second path, a first position guiding the tablets in the tablet assembly space into the first path, and a second position guiding the tablets in the tablet assembly space into the second path; and a driving motor that provides a rotation power for rotating the rotary plate according to a result of detecting by the error detecting unit.

* * * * *